US007068176B2

(12) United States Patent
Black et al.

(10) Patent No.: US 7,068,176 B2
(45) Date of Patent: Jun. 27, 2006

(54) SMOKE DETECTOR WITH SOUND QUALITY ENHANCEMENT CHAMBER

(75) Inventors: Kevin Bruce Black, Roswell, GA (US); John D. Coleman, Philadelphia, PA (US); Matthew P. Lyons, Brogue, PA (US); Mathieu D. D. Turpault, Berwyn, PA (US)

(73) Assignee: SignalOne Safety, Inc., Roswell, GA (US)

( * ) Notice: Subject to any disclaimer, the term of this patent is extended or adjusted under 35 U.S.C. 154(b) by 95 days.

(21) Appl. No.: 10/790,380

(22) Filed: Mar. 1, 2004

(65) Prior Publication Data

US 2005/0190067 A1 Sep. 1, 2005

(51) Int. Cl.
*G08B 17/10* (2006.01)

(52) U.S. Cl. ..... 340/628; 340/692

(58) Field of Classification Search ..... 340/628, 340/388.4, 391.1, 692, 693.5, 693.6
See application file for complete search history.

(56) References Cited

U.S. PATENT DOCUMENTS

| | | | | |
|---|---|---|---|---|
| 4,075,614 | A * | 2/1978 | White | 340/594 |
| 4,297,538 | A * | 10/1981 | Massa | 381/340 |
| 4,328,486 | A * | 5/1982 | Burnstein et al. | 340/391.1 |
| 4,963,855 | A * | 10/1990 | Kojima | 340/388.4 |
| 5,349,338 | A * | 9/1994 | Routman et al. | 340/692 |
| 5,396,221 | A * | 3/1995 | Bridges | 340/628 |

* cited by examiner

*Primary Examiner*—John Tweel, Jr.
(74) *Attorney, Agent, or Firm*—Akerman Senterfitt; Michael K. Dixon

(57) ABSTRACT

A smoke detector having a sound quality enhancement chamber for increasing the sound quality of alarms produced by a sound producing device in the smoke detector. In at least one embodiment, the sound quality enhancement chamber is formed by a housing and a plate such that the chamber is in communication with a sound producing device, which may be a speaker, for producing sounds, such as a human voice, with enhanced quality. The sound quality enhancement chamber acts as a spring and increases the quality of the sounds produced by the sound producing device of the smoke detector. In at least one embodiment, the sound quality enhancement chamber enables a smoke detector to emit a parent's voice that is clear and easily understandable.

30 Claims, 4 Drawing Sheets

SMOKE DETECTOR WITH SOUND QUALITY ENHANCEMENT CHAMBER

FIELD OF THE INVENTION

The invention is directed generally to smoke detectors, and more particularly, to smoke detectors capable of producing audible alarms.

BACKGROUND

There exist numerous types of smoke detectors. Some smoke detectors produce an audible alarm, such as an alarm generated from a buzzer or a speaker, while other smoke detectors produce a visual alarm. The success of smoke detectors with audible alarms correlates directly with the quality of the sound generated by the smoke detector and the type of audible alarm produced. For instance, recent tests have shown that children experience deeper stages of non-rapid eye movement (NREM), particularly at stages three and four, than adults and have higher arousal thresholds. As a result, more often than not, children sleep through the alarms found in conventional smoke detectors. These tests have also shown that children are very likely to wake up from a deep sleep when they hear the voice of one of their parents.

As a result of these tests, smoke detectors capable of replaying voice recordings have been developed that enable parents to record their voice on a smoke detector so that when the smoke detector detects the presence of smoke, the smoke detector plays the prerecorded voice of a parent instructing the child to wake up and leave the room as previously taught. Smoke detectors such as these have proved to be more successful in awakening sleeping children than conventional smoke alarms.

While these recordable smoke detectors have been more successful in awakening sleeping children, these recordable detectors have not always performed adequately. For instance, the quality of a playback of a voice message is not always sufficient. More particularly, many smoke detectors suffer from having the inability to produce a loud, clear voice in a cost efficient manner. Thus, a need exists for a smoke detector having improved playback features for increasing the quality of voice playback in smoke detectors.

SUMMARY OF THE INVENTION

The invention is directed to a smoke detector for detecting smoke and creating at least an audible alarm for informing occupants of a home of a fire. The smoke detector may include a detection device for detecting smoke, a sound producing device, which may be a speaker, for producing an alarm, a housing containing the speaker and the detection device, and a sound quality enhancement chamber forming a resonant element that is contained in the housing and is in communication with the speaker for increasing the quality of sounds produced by the speaker. The sound quality enhancement chamber may be formed from numerous sizes and materials.

In at least one embodiment, the sound quality enhancement chamber may be formed from a plate and an inner surface of a housing forming a portion of the smoke detector. The plate may be attached to the inner surface, may form a gap between the inner surface of the housing and edges of the plate, or may be attached in other configurations. The speaker may be placed completely in the sound quality enhancement chamber or may be positioned in other configurations. Use of the sound quality enhancement chamber in the smoke detector enhances the quality of the sounds produced by the sound producing device. For instance, in at least one embodiment, addition of the sound quality enhancement chamber to a smoke detector has yielded an increase in output of a speaker from about 82 decibels for a smoke detector without a sound quality enhancement chamber to about 92 decibels for a smoke detector with a sound quality enhancement chamber with all other variables remaining constant. In addition, an increase of about two decibels from about 92 decibels to about 94 decibels has been realized when the plate forming a portion of the sound quality enhancement chamber is not attached to the housing and a gap exists between an inner surface in the housing and edges of the plate.

Use of the sound quality enhancement chamber is particularly useful when the sound producing device emits a voice because the voice may be projected at higher decibels without increasing power consumption or altering other parameters of a smoke detector, which typically results in use of more expensive components. In addition, use of the sound quality enhancement chamber often times makes a voice produced by a speaker in a smoke detector clearer and easier to understand. These and other advantages and embodiments of the invention are described below.

BRIEF DESCRIPTION OF THE DRAWINGS

The accompanying drawings, which are incorporated in and form a part of the specification, illustrate preferred embodiments of the presently disclosed invention(s) and, together with the description, disclose the principles of the invention(s). These several illustrative figures include the following.

DETAILED DESCRIPTION OF THE INVENTION

Figure 1:
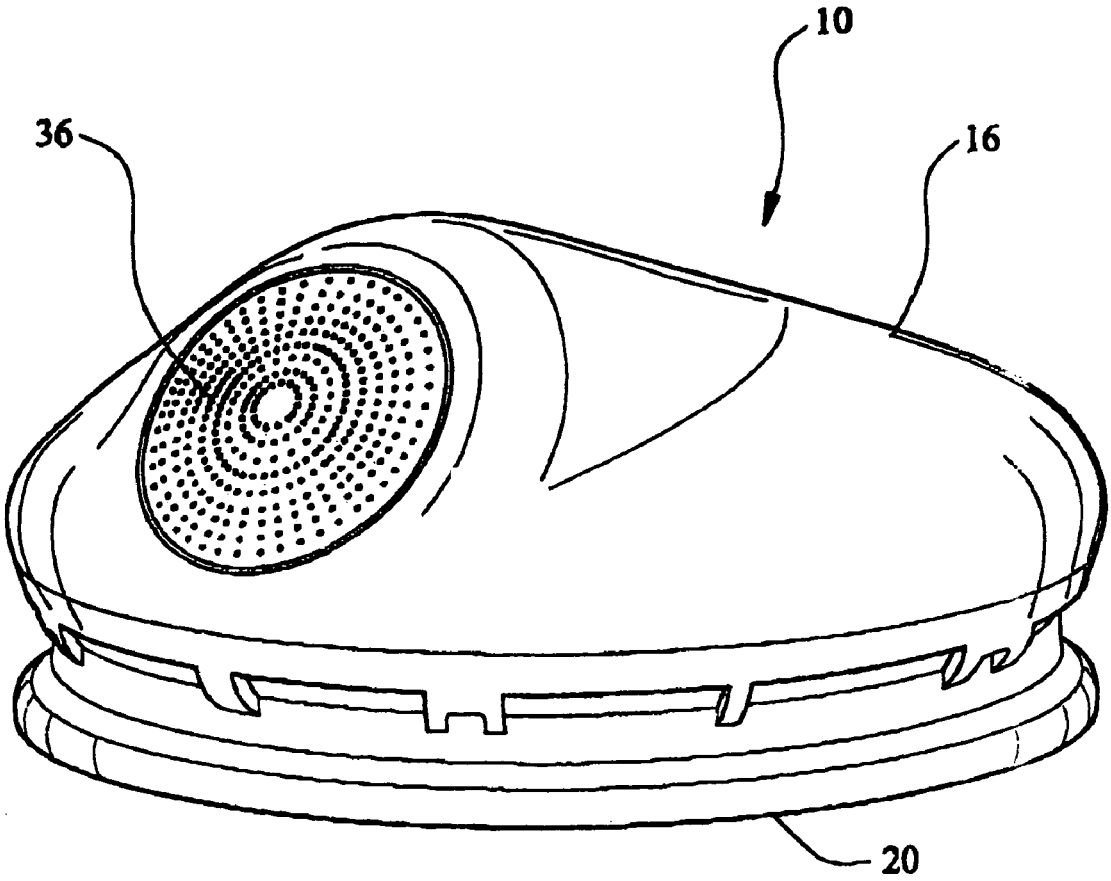
FIG. 1 is a perspective view of a smoke detector including aspects of this invention.
Figure 2:
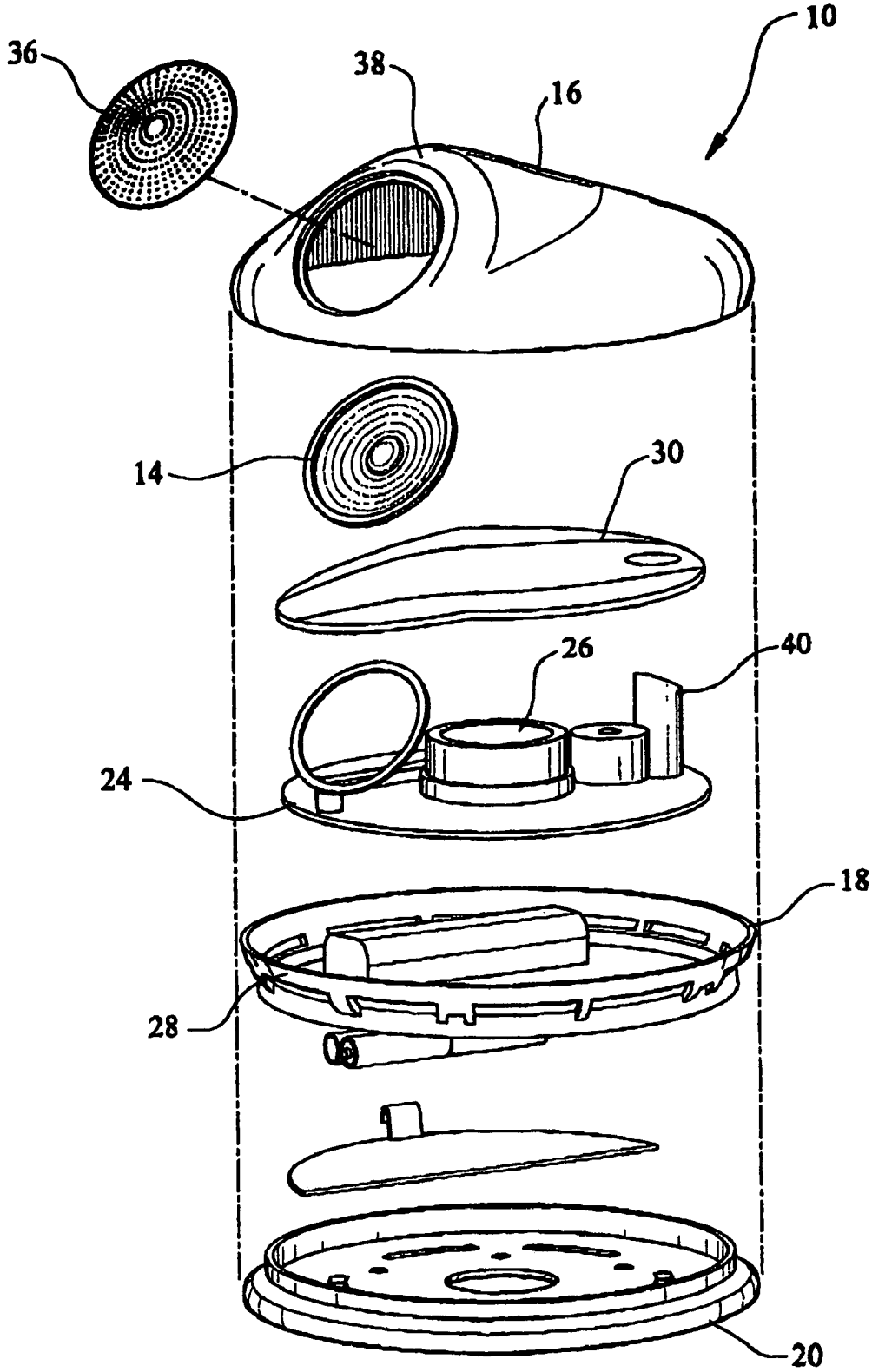
FIG. 2 is an exploded view of FIG. 1.
Figure 3:
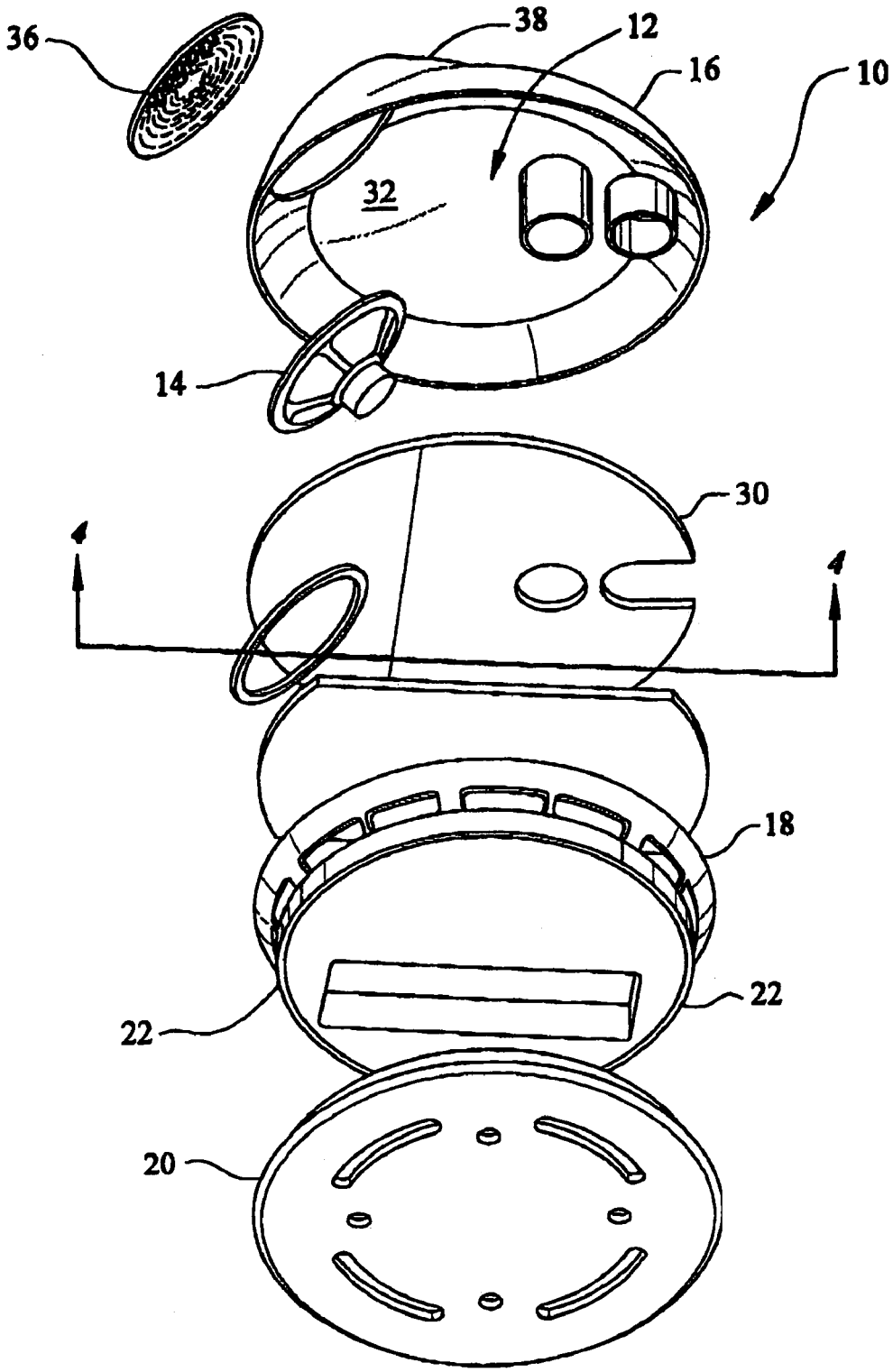
FIG. 3 is a partial exploded view of FIG. 1.

This invention is directed to a smoke detector 10, as shown in FIGS. 1–4, usable to produce one or more alarms when smoke is detected by the smoke detector 10. The smoke detector 10 includes a sound quality enhancement chamber 12, as shown in FIG. 3, for increasing the quality of the alarm produced by the smoke detector 10 and for increasing other characteristics of the alarm sound. For purposes of this description, increased smoke alarm quality means broadening the frequency response of the sounds produced by the smoke detector 10 so that voices produced by the smoke detector 10 have proper tone.

The sound quality enhancement chamber 12 enhances the sound produced by a sound producing device 14, which may be, but is not limited to being, a speaker, a buzzer, or other appropriate device. Incorporation of the sound quality enhancement chamber 12 into the smoke detector 10 increases the sound producing capabilities of the smoke detector 10. The sound quality enhancement chamber 12 may be included in a variety of smoke detectors for increasing the quality of the sound produced by the detector into which it is mounted and is not limited to being included only in smoke detectors similar to the detector described below.

As shown in FIGS. 2 and 3, the smoke detector 10 may include a housing 16 adapted to be coupled to a base 18. The housing 16 may be formed from any appropriate shape enabling the housing 16 to fit on the base 18. The housing 16 may be formed from materials, such as but not limited to, plastics and metals. The base 18 may be attached to a wall, ceiling, or other structure in a building or, as shown in FIG. 3, may be releaseably attached to a bracket 20 that is configured to be attached to a wall, ceiling, or other structure. The base 18 may include a connection device 22 enabling the base 18 to be releaseably connected to the bracket 20. The bracket 20 may include a plurality of holes enabling the bracket 20 to be screwed to a surface.

The base 18 may also be configured to accept a control board 24. The control board 24 may include a detection device 26 for detecting smoke, a microcontroller 28, and other devices. The detection device 26 may be, but is not limited to being, an ionization detector, a photoelectric detector, or other appropriate detector. The microcontroller 28 may be programmable and capable of storing one or more alarm messages to be played when an alarm condition is recognized by the detection device 26, or a test procedure is run, such as by a user depressing a button. The microprocessor 28, the sound producing device 14, and other electrical components may be powered by batteries contained in the smoke detector 10, municipal power supplies, solar energy systems, or other power sources.

In at least one embodiment of the invention, the microcontroller 28 may be capable of recording one or more alarm messages that are to be played by the sound producing device 14 when the detection device 26 detects smoke or undergoes a test run. The alarm message may be that of a parents voice instructing their child to wake up, exit the room in the manner they were taught, and meet outside at the family meeting place. For instance, the alarm message may include "Wake up Johnny, wake up. There is a fire in our house. Please exit your room as I taught you and meet me outside at our family meeting spot." Such a message, when spoken by a parent, is very effective in awakening sleeping children as children are more prone to sleep through fire alarms and other sounds because they experience deeper non-random eye movement (NREM), such as at stages three and four, and children have a higher threshold for arousal than adults.

The smoke detector 10 may also include the sound quality enhancement chamber 12 for increasing the quality of the sound produced by the sound producing device 14. The sound quality enhancement chamber 12 may be formed from numerous materials and configurations. In at least one embodiment, the sound quality enhancement chamber 12 may be formed from the housing 16 and a plate 30. While the plate 30 shown in FIGS. 2 and 3 is shown as a relatively flat disc, the plate 30 is not limited to this configuration. Rather, the plate 30 may be any configuration for increasing the quality of the sound produced by the sound producing device 14. In one embodiment, the plate 30 may be attached to an inner surface 32 of housing 16 to seal the plate 30 to the housing. The plate 30 may be attached to the inner surface 32 of the housing 16 using a caulk, a sealant, or other appropriate material, and if the plate 30 and housing 16 are made of metal, the plate 30 may be welded to the inner surface 32. The inner surface 32 of the housing may have a substantially hemispherical shape or other appropriate shape forming the sound quality enhancement chamber 12.

Figure 4:
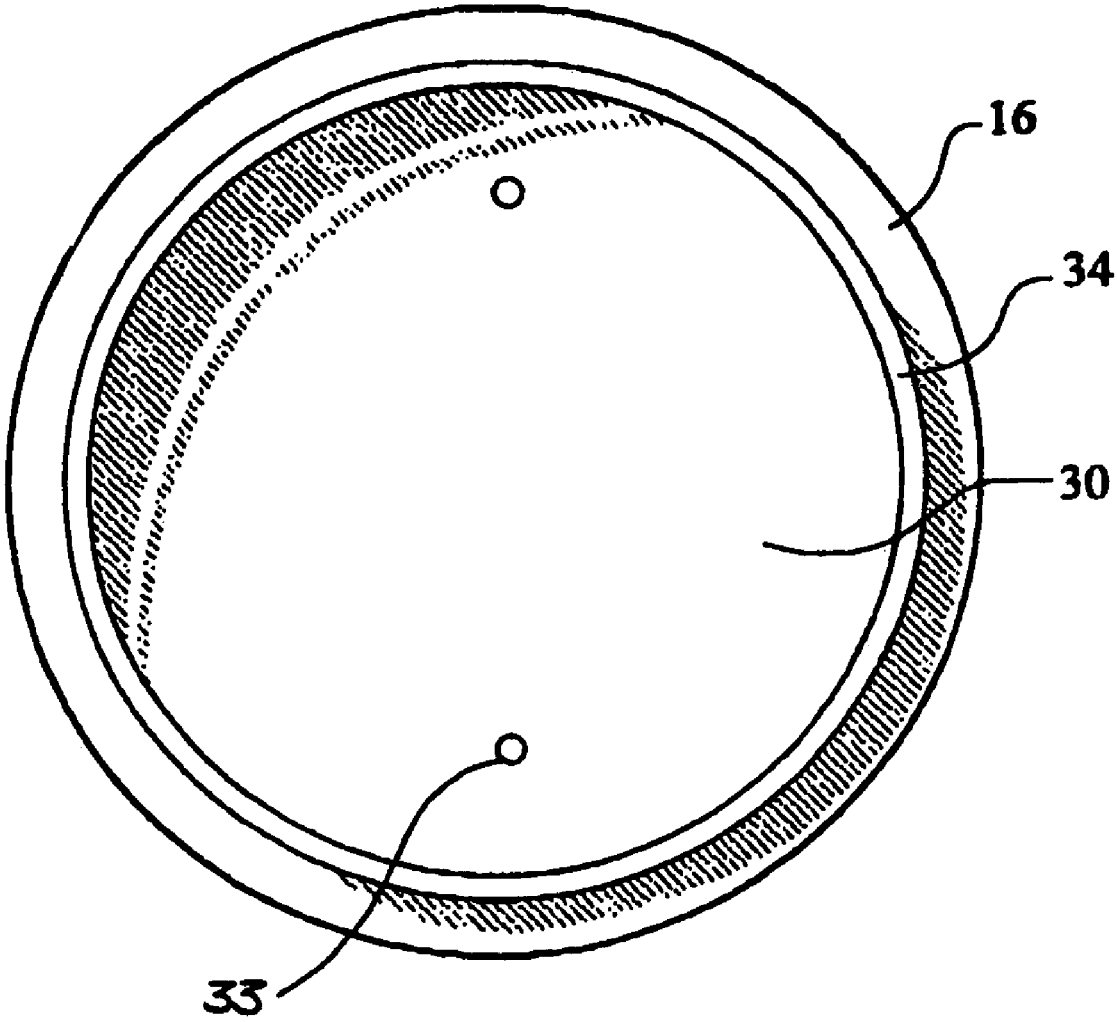
FIG. 4 is a bottom view of a portion of the smoke detector taken at lines 4—4 in FIG. 3.

In another embodiment, the plate 30 may not be in contact with the inner surface 32 of the housing 16. Instead, one or more ports 33 may be in the plate 30 forming a vented sound quality enhancement chamber 12. A vented sound quality enhancement chamber 12 has one or more apertures in the walls forming the chamber 12. The ports 33 may take the form of one or more apertures in the plate 30 or may be a gap 34, as shown in FIG. 4, present between edges of the plate 30 and the inner surface 32 of the housing 16. The gap 34 may extend substantially around all edges of the plate 30. In this embodiment, the plate may be attached to the base 18 using heat staking or other appropriate manners. The gap 34 may enable the plate 30 to vibrate and increase the quality of the sound emitted by the smoke detector. In at least one embodiment, the smoke detector 10 may include a plurality of gaps 34 between the plate 30 and an inner surface 32 of the housing 16 and a plurality of locations where the plate 30 is attached to the inner surface 32 of the housing 16. The ports 33 may exist in the plate 30 or housing 16 and number one or more. In addition, the ports 33 may be of varying size and configuration. The ports 33 increase the quality of the sound emitted by the sound producing device 14.

The sound producing device 14 may be in communication with the sound quality enhancement chamber 12, as shown in FIG. 2, such that sound waves produced by the sound producing device 14 are emitted into the sound quality enhancement chamber 12. In at least one embodiment, the sound producing device 14 is positioned in the sound quality enhancement chamber 12. The sound producing device 14 may also be mounted to the plate 30. In yet another embodiment, the sound producing device 14 may be positioned in the sound quality enhancement chamber 12 proximate to the inner surface 32 of the housing 16. In embodiments where the sound producing device 14 is a speaker and positioned proximate to the inner surface 32, a front face of the speaker may be positioned proximate to the inner surface 32 of the housing 16. The housing 16 may or may not include a grill 36 for emitting sound waves from the sound quality enhancement chamber 12. In at least one embodiment, as shown in FIG. 3, the inner surface 32 of the housing 16 is substantially hemispherical except for a bulb 38 that forms a head for the grill 36.

The sound quality enhancement chamber 12 may be formed from different sizes and configurations. The sound quality enhancement chamber 12 may have a volume of between about seven cubic inches and about twenty cubic inches. In one exemplary embodiment of the smoke detector 10, the sound quality enhancement chamber 12 may have a volume of about thirteen cubic inches. Numerous factors account for determining the proper size of the sound quality enhancement chamber 12. For instance, the sound quality enhancement chamber 12 is a sealed volume of air that acts as a resonant element or a spring. This volume of air can be tuned to enhance the low frequency response of the sound producing device 14. The size of the sound quality enhancement chamber 12 is determined by how low the frequency of the sound produced by the sound producing device 14 is desired to be and how loud the sound is desired to be. Thus, the size of the sound quality enhancement chamber 12 is dictated by the volume and frequency of the sound produced by the sound producing device 14.

In one exemplary embodiment, the sound quality enhancement chamber 12 has a volume of about thirteen cubic inches, and the smoke detector 10 includes an amplifier 40 for amplifying sound emitted by the sound emitting device 14. The amplifier 40 can operate at about 3 volts at 250 milliamps, thereby enabling the amplifier to operate at about 90–95 decibels with an output about 0.75 Watts. The speaker is rated for one Watt average consumption and 1.5 Watts of peak power input. Inclusion of the sound quality enhancement chamber 12 with this setup enables sounds emitted from the smoke detector 10, when tested about ten feet from the smoke detector 10, to be about 10 decibels higher than smoke detectors 10 having this setup without the sound quality enhancement chamber 12. This test was performed with a speaker pointing towards a sound meter, and the units are decibels in scale c, which are weighted for human hearing.

In addition, smoke detectors 10 using a sound quality enhancement chamber 12 that is not attached to the inner surface 32 of the housing 16, but rather is attached to the base 18 and includes gaps 34, as shown in FIG. 4, between the plate 30 and an inner surface 32 of the housing 16, realizes an even greater increase in decibels of sounds produced by the sound producing device 14. For instance, in at least one embodiment, the use of gaps between the plate 30 and an inner surface 32 of a housing 16 enables sounds to be produced at levels of about 12 decibels louder than smoke detectors 10 without the sound quality enhancement chamber 12 and about 2 decibels louder than smoke detectors 10 with the sound quality enhancement chamber 12 and having the plate 30 attached and sealed to the inner surface 32 of the housing 16.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A smoke detector, comprising:

a control board;

a detection device for detecting smoke coupled to the control board;

a sound producing device for producing an alarm;

a housing containing the sound producing device and the detection device;

a sound quality enhancement chamber partially formed by an inner surface of the housing and a plate positioned within the housing between the control board and the housing and generally parallel to the control board and forming a resonant element, wherein the sound quality enhancement chamber is in communication with the sound producing device for increasing the quality of sounds produced by the sound producing device.

2. The smoke detector of claim 1, wherein the plate is sealed to the inner surface of the housing forming a sealed resonant chamber.

3. The smoke detector of claim 1, wherein a gap exists between an edge of the plate and the inner surface of the housing.

4. The smoke detector of claim 3, wherein the gap extends substantially around all edges of the plate.

5. The smoke detector of claim 1, wherein the sound quality enhancement chamber forming the resonant element has a volume between about seven cubic inches and about twenty cubic inches.

6. The smoke detector of claim 5, wherein the sound quality enhancement chamber has a volume of about thirteen cubic inches.

7. The smoke detector of claim 1, wherein the sound quality enhancement chamber is vented.

8. The smoke detector of claim 1, wherein a front face of the sound producing device is proximate to an inner surface of the sound quality enhancement chamber.

9. The smoke detector of claim 8, wherein the front face of the sound producing device is proximate to a grill forming a portion of the housing.

10. The smoke detector of claim 1, wherein an inner surface of the housing forming at least a portion of the sound quality enhancement chamber is substantially hemispherical.

11. A smoke detector, comprising:

a control board;

a detection device for detecting smoke coupled to the control board;

a sound producing device for producing alarms;

a housing containing the sound producing device and the detection device;

a sound quality enhancement chamber partially formed by an inner surface of the housing and a plate positioned within the housing between the control board and the housing and generally parallel to the control board forming a resonant element that is contained in the housing; and wherein the sound producing device is contained substantially in the sound quality enhancement chamber.

12. The smoke detector of claim 11, wherein the plate is sealed to the inner surface of the housing forming a sealed resonant chamber.

13. The smoke detector of claim 11, wherein a gap exists between an edge of the plate and the inner surface of the housing.

14. The smoke detector of claim 13, wherein the gap extends substantially around all edges of the plate.

15. The smoke detector of claim 11, wherein the sound quality enhancement chamber is vented.

16. The smoke detector of claim 11, wherein the sound quality enhancement chamber forming the resonant element has a volume between about seven cubic inches and about twenty cubic inches.

17. The smoke detector of claim 16, wherein the sound quality enhancement chamber has a volume of about thirteen cubic inches.

18. The smoke detector of claim 11, wherein a fiont face of the sound producing device is proximate to an inner surface of the sound quality enhancement chamber.

19. The smoke detector of claim 18, wherein the front face of the sound producing device is proximate to a grill forming a portion of the housing.

20. The smoke detector of claim 11, wherein an inner surface of the housing forming at least a portion of the sound quality enhancement chamber is substantially hemispherical.

21. A smoke detector, comprising:

a control board;

a detection device for detecting smoke coupled to the control board;

a housing containing a sound producing device and a detection device for detecting smoke;

a recordable playback device for recording at least one alarm message and playing the at least one alarm message in the event the detection device detects the presence of smoke; and a sound quality enhancement chamber partially formed by an inner surface of the housing and a plate positioned within the housing between the control board and the housing and generally parallel to the control board and in communication with the sound producing device forming a resonant element for increasing the quality of sounds produced by the sound producing device.

22. The smoke detector of claim 21, wherein the plate is sealed to the inner surface of the housing forming a sealed resonant chamber.

23. The smoke detector of claim 21, wherein a gap exists between an edge of the plate and the inner surface of the housing.

24. The smoke detector of claim 23, wherein the gap extends substantially around all edges of the plate.

25. The smoke detector of claim 21, wherein the sound quality enhancement chamber is vented.

26. The smoke detector of claim 21, wherein the sound quality enhancement chamber fonning the resonant element has a volume between about seven cubic inches and about twenty cubic inches.

27. The smoke detector of claim 26, wherein the sound quality enhancement chamber has a volume of about thirteen cubic inches.

28. The smoke detector of claim 21, wherein a front face of the sound producing device is proximate to an inner surface of the sound quality enhancement chamber.

29. The smoke detector of claim 28, wherein the front face of the sound producing device is proximate to a grill forming a portion of the housing.

30. The smoke detector of claim 21, wherein an inner surface of the housing forming at least a portion of the sound quality enhancement chamber is substantially hemispherical.

* * * * *

UNITED STATES PATENT AND TRADEMARK OFFICE

CERTIFICATE OF CORRECTION

PATENT NO. : 7,068,176 B2
APPLICATION NO. : 10/790380
DATED : June 27, 2006
INVENTOR(S) : Black et al.

It is certified that error appears in the above-identified patent and that said Letters Patent is hereby corrected as shown below:

Claim 18, column 6, line 39, replace “fiont” with --front--.

Signed and Sealed this

Twelfth Day of September, 2006

JON W. DUDAS
*Director of the United States Patent and Trademark Office*